US010096950B2

(12) United States Patent
Wu et al.

(10) Patent No.: US 10,096,950 B2
(45) Date of Patent: Oct. 9, 2018

(54) CABLE CONNECTOR ASSEMBLY HAVING A PHYSICAL RESISTOR ARRANGED IN A LARGER ONE OF TWO CABLE END CONNECTORS THEREOF

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/696,115

(22) Filed: Sep. 5, 2017

(65) Prior Publication Data

US 2018/0069351 A1 Mar. 8, 2018

(30) Foreign Application Priority Data

Sep. 5, 2016 (CN) ..... 2016 2 1036809 U

(51) Int. Cl.
*H01R 24/00* (2011.01)
*H01R 33/00* (2006.01)
(Continued)

(52) U.S. Cl.
CPC ..... *H01R 13/6616* (2013.01); *H01R 13/5845* (2013.01); *H01R 24/60* (2013.01)

(58) Field of Classification Search
CPC ..... H01R 13/6616; H01R 13/5845; H01R 13/6471; H01R 24/60; H01R 24/62;
(Continued)

(56) References Cited

U.S. PATENT DOCUMENTS 7,534,143 B1 * 5/2009 Tsao ..... H01R 13/58 439/497
8,113,870 B2 * 2/2012 Su ..... H01R 13/5816 439/455
(Continued)

FOREIGN PATENT DOCUMENTS

CN 105470688 4/2016

*Primary Examiner* — Hae Moon Hyeon
(74) *Attorney, Agent, or Firm* — Wei Te Chung; Ming Chieh Chang

(57) ABSTRACT

A cable connector assembly includes: a first cable end connector (200) including an insulative support (210), plural contacts (211) insert molded with the insulative support, and a front insulative body (20) mounted to the insulative support, the contacts including a pair of USB 2.0 signal contacts (2110), plural power contacts (2111), plural ground contacts (2112), and a detection contact (2113); a second cable end connector (300) including an insulative base (30) and plural contacts (31) insert molded with the insulative base, the contacts including a pair of signal contacts (311), a power contact (312), and a ground contact (313); a cable (400) connected therebetween, the cable including a detection wire (404) connected to the detection contact; and a physical resistor (25) connected between the detection wire of the cable and the power contact; wherein the insulative base is of a larger size than the insulative support.

9 Claims, 8 Drawing Sheets

(51) Int. Cl.
*H01R 13/66* (2006.01)
*H01R 24/60* (2011.01)
*H01R 13/58* (2006.01)

(58) Field of Classification Search
CPC ..... H01R 4/023; H01R 12/53; H01R 23/62; H01R 23/7303
USPC ..... 439/660, 638, 620.04, 455
See application file for complete search history.

(56) References Cited

U.S. PATENT DOCUMENTS

| | | | | |
|---|---|---|---|---|
| 9,356,400 | B2 * | 5/2016 | Little | H01R 4/023 |
| 9,490,549 | B2 * | 11/2016 | Little | H01R 4/023 |
| 2008/0167828 | A1 | 7/2008 | Terlizzi et al. | |
| 2011/0143577 | A1 * | 6/2011 | Su | H01R 13/5816 439/460 |
| 2015/0106539 | A1 | 4/2015 | Leinonen et al. | |
| 2015/0318646 | A1 | 11/2015 | Little et al. | |
| 2015/0372429 | A1 | 12/2015 | Lee et al. | |
| 2016/0006190 | A1 * | 1/2016 | Katsuura | H02H 5/04 439/502 |
| 2016/0276789 | A1 | 9/2016 | Cheng et al. | |
| 2017/0005447 | A1 | 1/2017 | Kim et al. | |
| 2017/0033513 | A1 | 2/2017 | Bae et al. | |
| 2017/0033520 | A1 | 2/2017 | Cheng et al. | |

* cited by examiner

CABLE CONNECTOR ASSEMBLY HAVING A PHYSICAL RESISTOR ARRANGED IN A LARGER ONE OF TWO CABLE END CONNECTORS THEREOF

BACKGROUND OF THE INVENTION

1. Field of the Invention

The present invention relates to a universal serial bus (USB) cable connector assembly having a physical resistor so arranged as to efficiently utilize space of cable end connectors thereof.

2. Description of Related Arts

U.S. Patent Application Publication No. 2016/0276789 discloses a cable connector assembly that may be used in a USB Type C to USB Type B cable assembly or to Type A receptacle adaptor situation where a ground terminal soldering leg and a detection terminal soldering leg are soldered with a resistor. Or it may be used in a USB Type A to USB Type C cable assembly or a USB Type B receptacle to USB Type C adaptor situation where a power terminal soldering leg and a detection terminal soldering leg are soldered with a resistor.

U.S. Patent Application Publication No. 2015/0372429 discloses a resistor included in a cable connector assembly, i.e., either in Type C or Type A, or in an external apparatus connected through its cable.

U.S. Patent Application Publication No. 2017/0005447 discloses a connecting device comprising a first connector having a first pin row, a second connector having a second pin row, a data line connecting a data pin of the first pin row and a data pin of the second pin row; and a recognition line connecting a power pin of the first pin row and a recognition pin of the second pin row through a physical element. The first connector may correspond to one of USB type A, USB type B, and USB type micro B; the second connector may correspond to USB type C. The physical element may comprise a resistor. The recognition pin may be a channel configuration (CC) pin based on USB 3.1 standard.

U.S. Patent Application Publication No. 2017/0033513 discloses a connecting device that may include a first connector, a second connector, a cable part between the first and second connectors, and a switching circuit connected to a recognition pin (e.g., a designated CC1 pin in the first connector). The switching circuit may include a switching part, a pull-down resistor, and a pull-up resistor.

A cable connector assembly having an improved arrangement of a physical resistor in a cable end connector thereof is desired.

SUMMARY OF THE INVENTION

A cable connector assembly comprises: a first cable end connector including an insulative support, a plurality of contacts insert molded with the insulative support, and a front insulative body mounted to the insulative support, the plurality of contacts including a pair of USB 2.0 signal contacts, plural power contacts, plural ground contacts, and a detection contact; a second cable end connector including an insulative base and a plurality of contacts insert molded with the insulative base, the plurality of contacts including a pair of signal contacts, a power contact, and a ground contact; a cable connected between the first and second cable end connectors, the cable including a detection wire connected to the detection contact of the first cable end connector; and a physical resistor connected between the detection wire of the cable and the power contact of the second cable end connector; wherein the insulative base of the second cable end connector is of a larger size than the insulative support of the first cable end connector.

DETAILED DESCRIPTION OF THE PREFERRED EMBODIMENT

Figure 1:
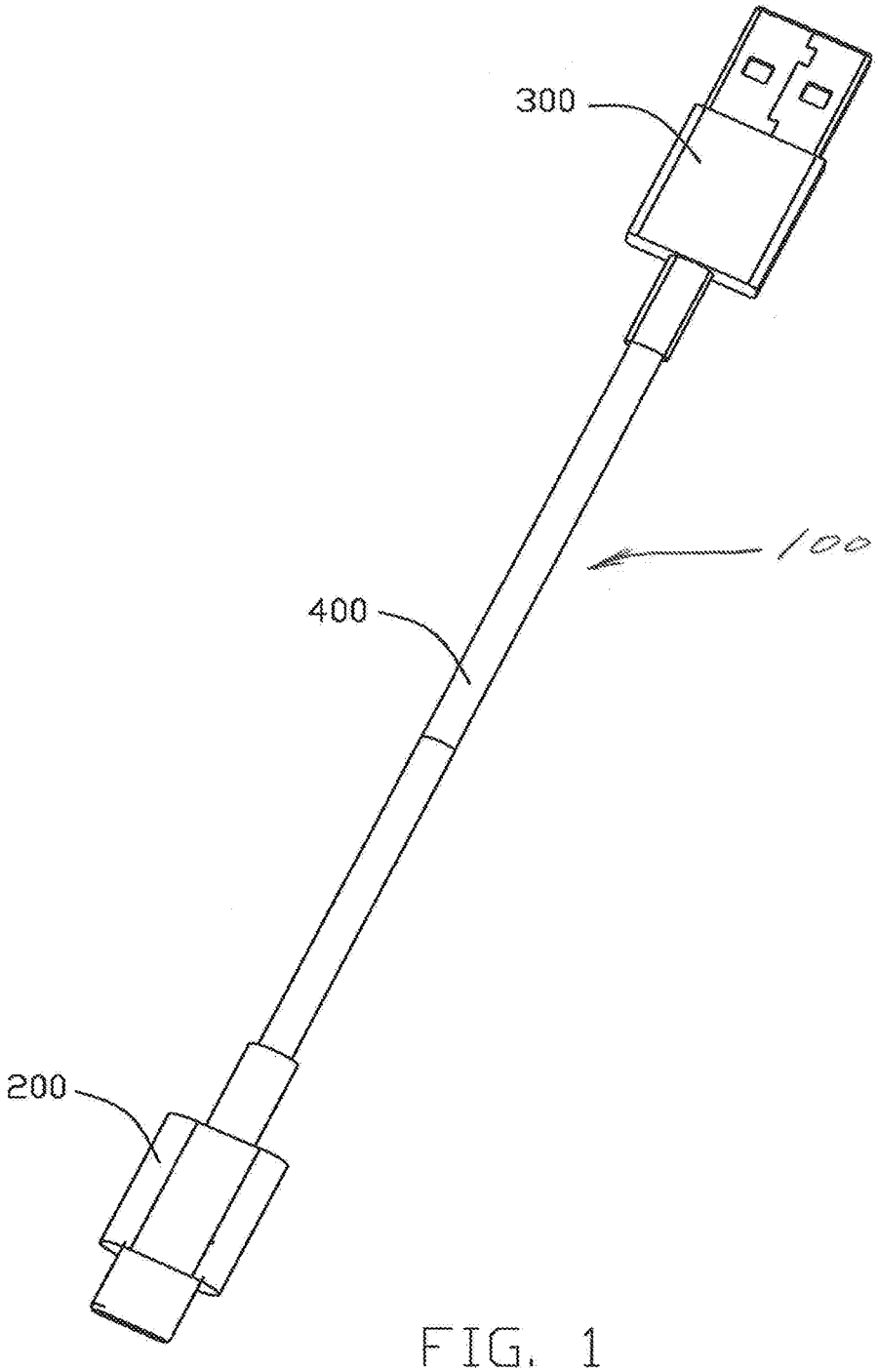
FIG. 1 is a perspective view of a cable connector assembly in accordance with the present invention.
Figure 2:
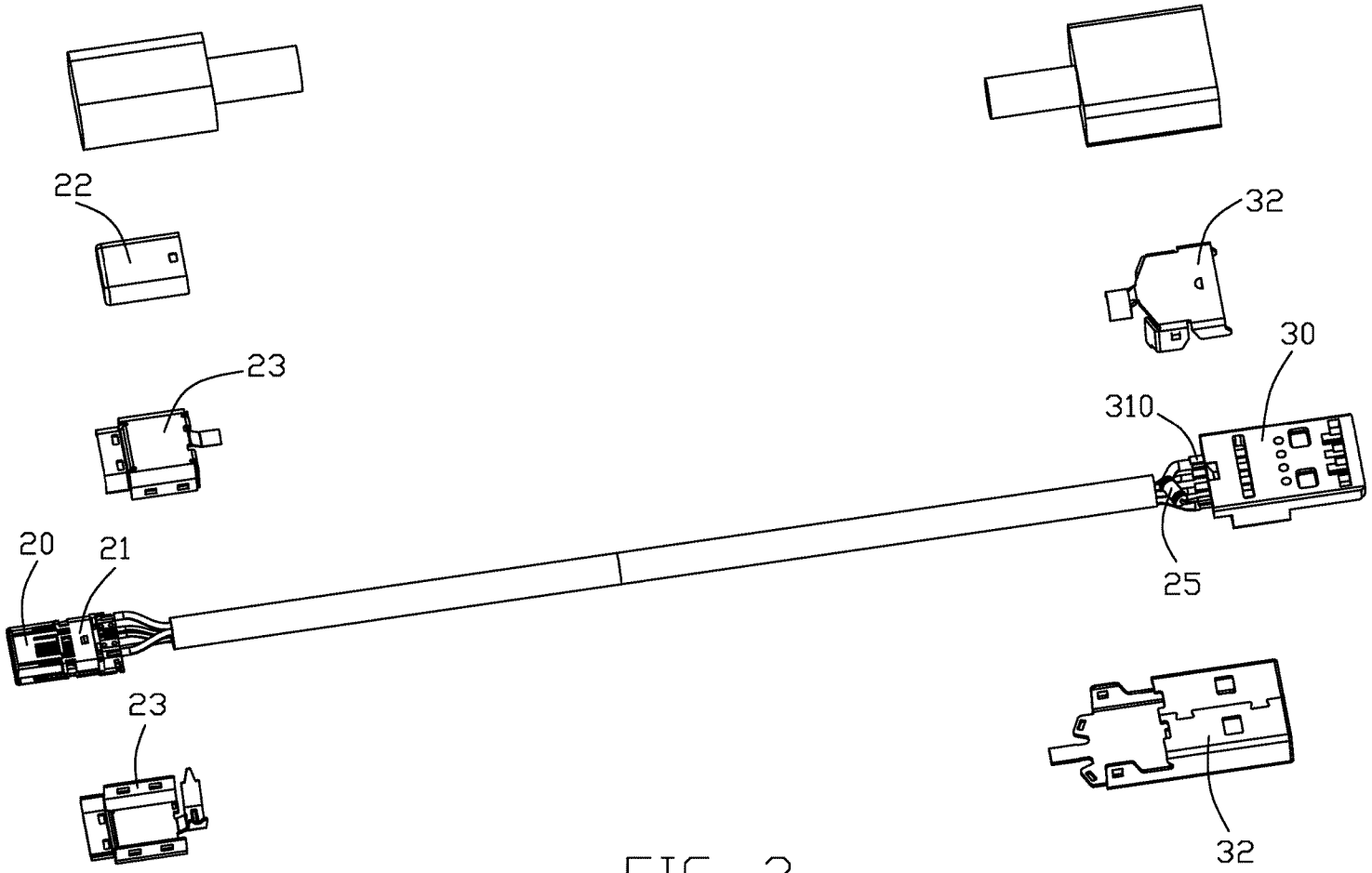
FIG. 2 is an exploded view of the cable connector assembly.
Figure 3:
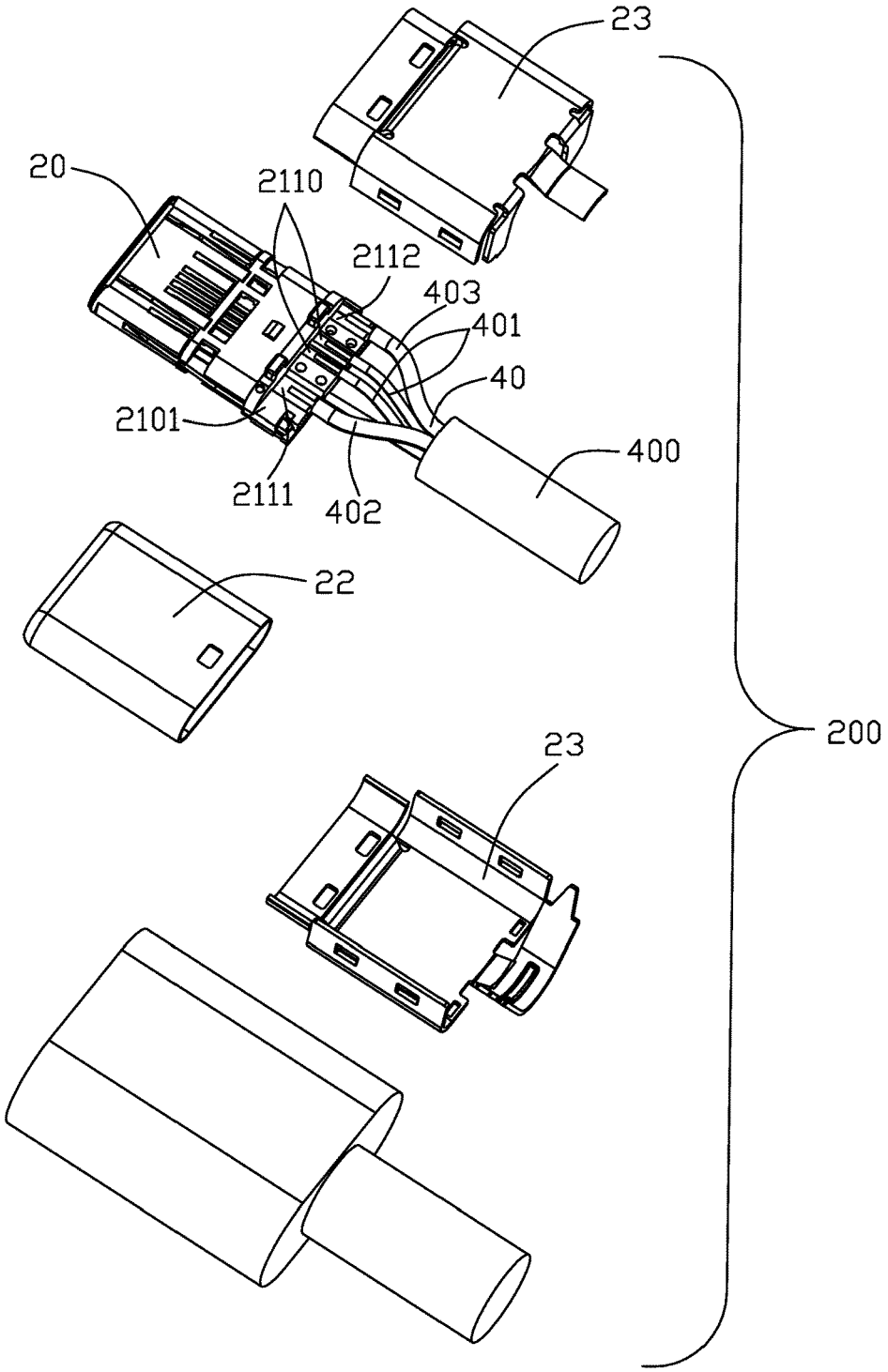
FIG. 3 is an exploded view of a first cable end connector of the cable connector assembly.
Figure 4:
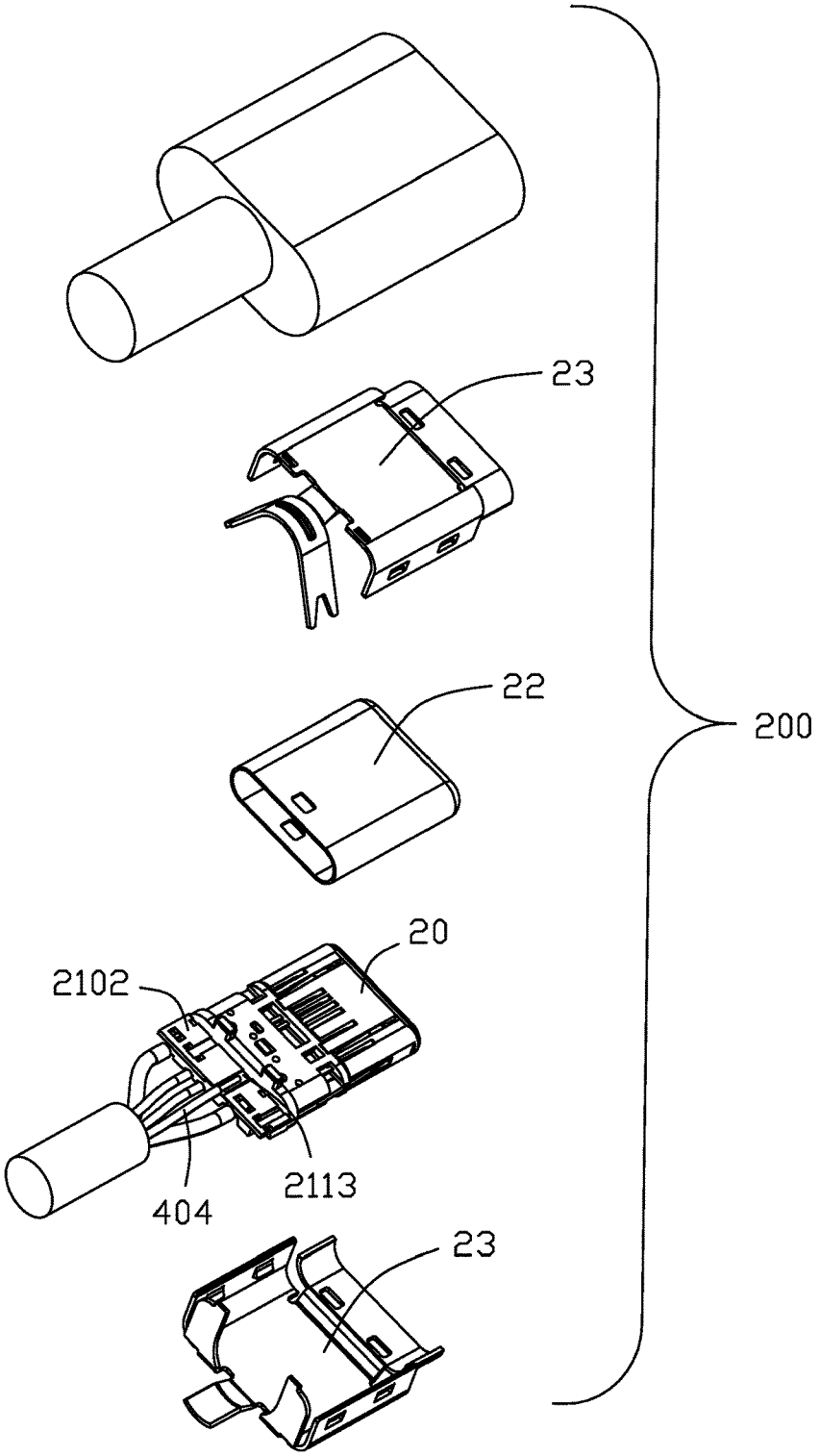
FIG. 4 is another exploded view of the first cable end connector.

As shown in FIG. 1, a cable connector assembly 100 includes a first cable end connector 200 capable of mating in dual orientations, a second cable end connector 300, and a cable 400 connected therebetween. The first cable end connector 200 may be of Type C for transmitting USB 2.0 signals; the second cable end connector 300 may be of STD A complying with USB Type A standard. The second cable end connector 300 is of a larger volume or size than the first cable end connector 200.

Referring to FIGS. 2-4 and 7-8, the first cable end connector 200 includes a front insulative body 20 and a rear terminal module 21 mounted to the insulative body 20. The first cable end connector 200 may further include a metal shell 22 enclosing the front insulative body 20, a shielding shell 23 enclosing the rear terminal module 21 and fastened to the cable 400, and an outer over-mold. The terminal module 21 includes an insulative support 210 and a plurality of contacts 211 insert molded with the insulative support 210. The plurality of contacts 211 have respective contact portions 212 extending into the front insulative body 20 and dedicated or shared solder tails 213 for directly soldering to wires of the cable 400. The plurality of contacts 211 are arranged in an upper row 214 and a lower row 215. The upper row 214 includes a pair of USB 2.0 signal contacts 2110, a pair of power contacts 2111, a pair of ground contacts 2112, and one detection contact 2113; the lower row 215 includes another pair of power contacts 2111 and another pair of ground contacts 2112. All power contacts 2111 in the two rows 214 and 215 are electrically connected; all ground contacts 2112 in the two rows 214 and 215 are electrically connected.

The front insulative body 20 has a mating space bordered by an interior wall surface thereof where the contact portions 212 are exposed. The first cable end connector 200 may further include a metal latch 24 having a pair of tails 241. The tails 241 sidewardly abut solder tails 213 of the ground contacts 2112 in the upper row 214.

The insulative support 210 has opposite upper surface 2101 and lower surface 2102. Solder tails 213 of the two signal contacts 2110, one of the pair of power contacts 2111, and one of the pair of ground contacts 2112 in the upper row 214 are exposed to the upper surface 2101 for ease of soldering operation. Solder tails 213 of the detection contact 2113 in the upper row 214 and the pair of power contacts 2111 and the pair of ground contacts 2112 in the lower row 215 are exposed to the lower surface 2102.

The cable 400 includes a plurality of wires 40, namely, a pair of signal wires 401, a power wire 402, a ground wire 403, and a detection wire 404. The pair of signal wires 401 are soldered directly to the solder tails of the pair of signal contacts 2110. The power wire 402 and the ground wire 403 are soldered directly to the solder tails 213 of the power contact 2111 and the ground contact 2112 exposed to the upper surface 2101 of the insulative support 210. The detection wire 404 is soldered directly to the solder tail 213 of the detection contact 2113 exposed to the lower surface 2102 of the insulative support 210.

Figure 5:
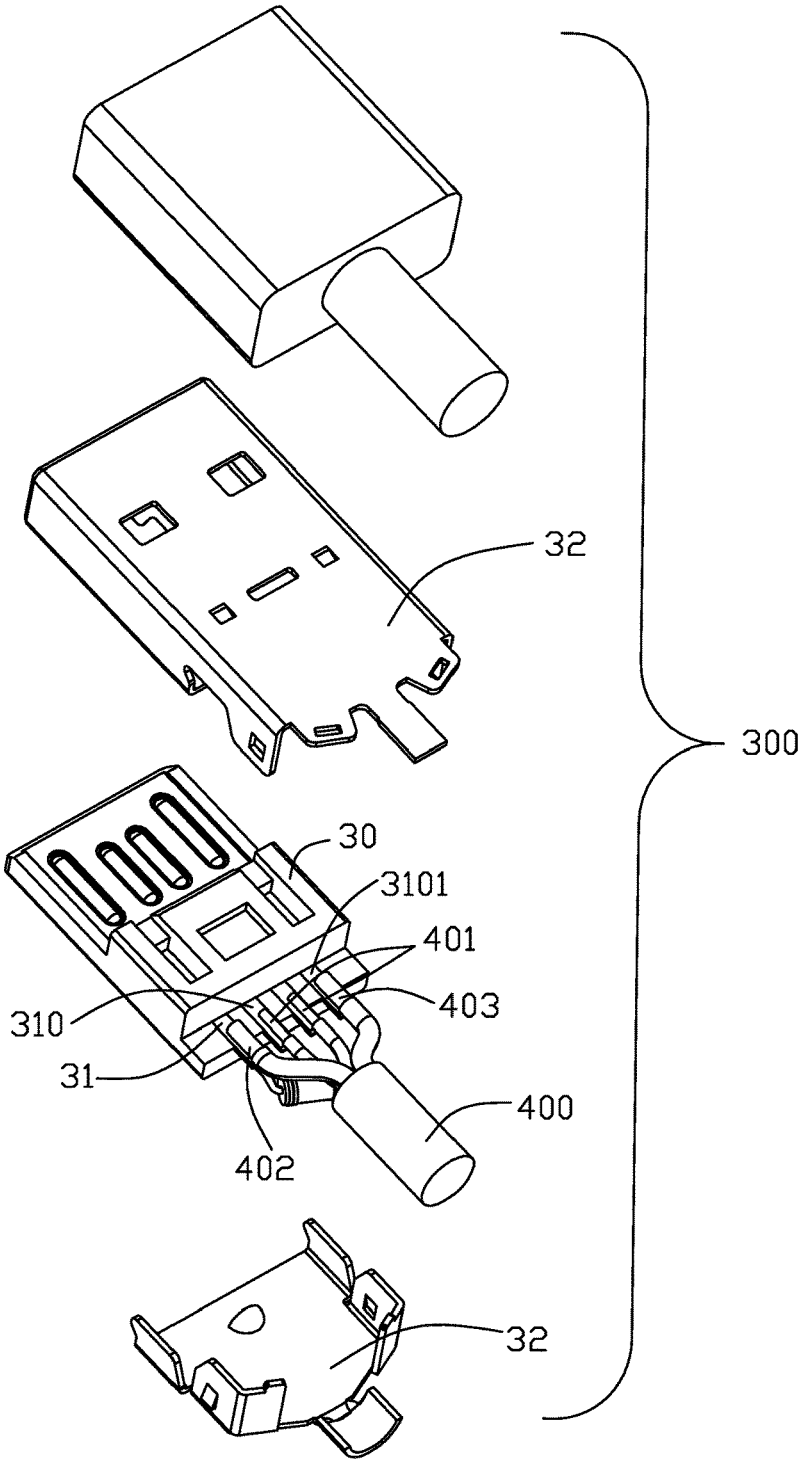
FIG. 5 an exploded view of a second cable end connector of the cable connector assembly.
Figure 6:
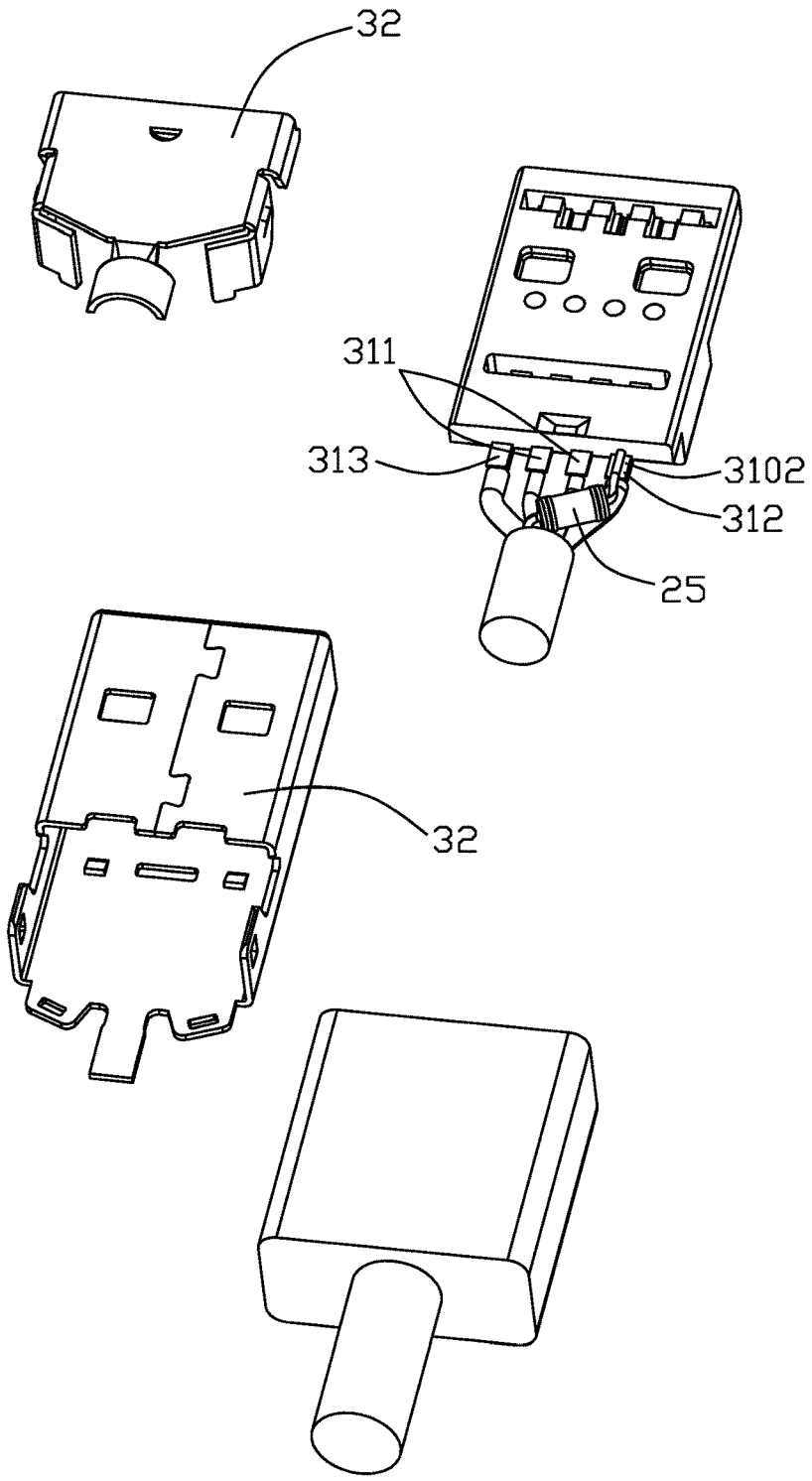
FIG. 6 is another exploded view of the first cable end connector.
Figure 7:
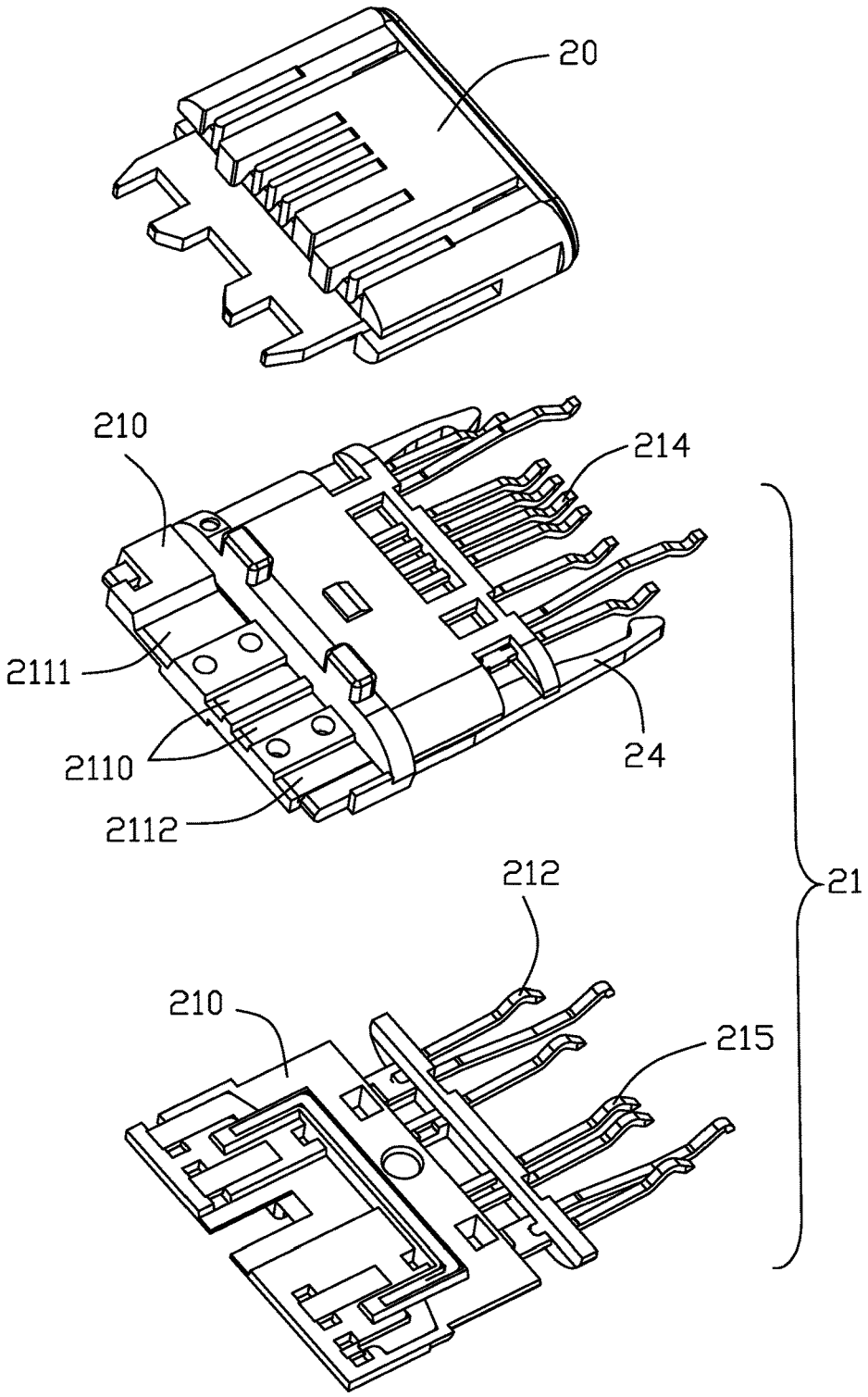
FIG. 7 is an exploded view of a terminal module and a front insulative body of the first cable end connector.
Figure 8:
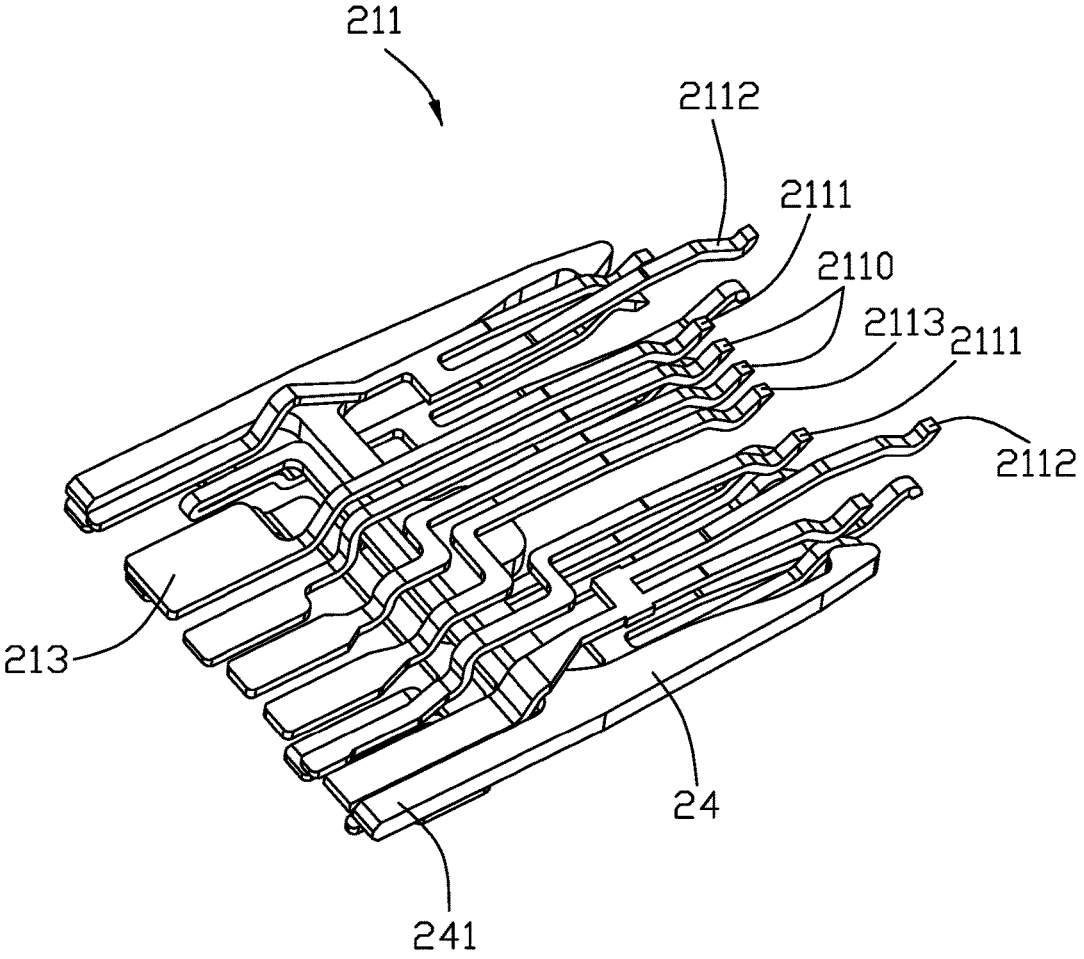
FIG. 8 is a perspective view of a plurality of contacts of the terminal module of the first cable end connector.

Referring to FIGS. 5-6, the second cable end connector 300 includes an insulative base 30 and a plurality of contacts 31 insert molded with the insulative base 30. The second cable end connector 300 may further include a shielding shell 32 enclosing the insulative base 30. Each of the contacts has a solder tail 310 extending rearwardly beyond the insulative base 30. The plurality of contacts 31 include a pair of signal contacts 311, a power contact 312, and a ground contact 313. The pair of signal wires 401 of the cable 400 are soldered directly to the pair of signal contacts 311. The power wire 402 of the cable 400 is soldered directly to the power contact 312. The ground wire 403 of the cable 400 is soldered directly to the ground contact 313. The solder tail 310 has opposite first surface 3101 and second surface 3102. The wires 40 of the cable 400 are all soldered to the first surface 3101. In this invention, a physical resistor 25 (e.g., 56 kΩ) is connected between the detection wire 404 of the cable 400 and the power contact 312 of the second cable end connector 300. Further, the resistor 25 is soldered to the second surface 3102 of the solder tail 310 of the power contact 312. By arranging the resistor 25 in the second cable end connector 300 having a larger size compared to the first cable end connector 200, the design is simplified. Notably, the first cable end connector 200 has the structures similar to the copending application Ser. No. 15/690,310 filed Aug. 30, 2017.

What is claimed is:

1. A cable connector assembly comprising:

a first cable end connector including an insulative support, a plurality of contacts insert molded with the insulative support, and a front insulative body mounted to the insulative support, the plurality of contacts including a pair of USB 2.0 signal contacts, plural power contacts, plural ground contacts, and a detection contact;

a second cable end connector including an insulative base and a plurality of contacts insert molded with the insulative base, the plurality of contacts including a pair of signal contacts, a power contact, and a ground contact;

a cable connected between the first and second cable end connectors, the cable including a detection wire connected to the detection contact of the first cable end connector; and a physical resistor connected between the detection wire of the cable and the power contact of the second cable end connector; wherein the insulative base of the second cable end connector is of a larger size than the insulative support of the first cable end connector.

2. The cable connector assembly as claimed in claim 1, wherein:

the power contact of the second cable end connector has a solder tail extending beyond the insulative base;

the cable includes a power wire connected to a first surface of the solder tail; and the physical resistor is soldered to an opposite second surface of the solder tail.

3. The cable connector assembly as claimed in claim 1, wherein;

the plurality of contacts of the first cable end connector are arranged in two rows;

the plural power contacts are disposed in the two rows, and all power contacts in the two rows are electrically connected; and the plural ground contacts are disposed in the two rows, and all ground contacts in the two rows are electrically connected.

4. A cable connector assembly comprising:

a first cable end connector including an insulative support, a plurality of contacts insert molded with the insulative support, and a front insulative body mounted to the insulative support, the plurality of contacts including a pair of USB 2.0 signal contacts, plural power contacts, plural ground contacts, and a detection contact;

a second cable end connector including an insulative base and a plurality of contacts insert molded with the insulative base, the plurality of contacts including a pair of signal contacts, a power contact, and a ground contact;

a cable connected between the first and second cable end connectors, the cable including a detection wire connected to the detection contact of the first cable end connector; and a physical resistor connected between the detection wire of the cable and the power contact of the second cable end connector; wherein the first cable end connector is a USB Type C plug connector while the second cable end connector is a USB Type A plug connector.

5. The cable connector assembly as claimed in claim 4, wherein the first cable end connector has the detection contact while the second cable end connector has no detection contact.

6. The cable connector assembly as claimed in claim 4, wherein the first cable end connector has at least eleven contacts while the second cable end connector has only four contacts.

7. A cable connector assembly comprising:

a first cable end connector including an insulative support, a plurality of contacts insert molded with the insulative support, and a front insulative body mounted to the insulative support, the plurality of contacts including a pair of USB 2.0 signal contacts, plural power contacts, plural ground contacts, and a detection contact;

a second cable end connector including an insulative base and a plurality of contacts insert molded with the insulative base, the plurality of contacts including a pair of signal contacts, a power contact, and a ground contact;

a cable connected between the first and second cable end connectors, the cable including a detection wire connected to the detection contact of the first cable end connector; and a resistor connected between the detection wire of the cable and one of the power contact and the ground contact of the second cable end connector; wherein the insulative base of the second cable end connector is of a larger size than the insulative support of the first cable end connector.

8. The cable connector assembly as claimed in claim 7, wherein:

the power contact of the second cable end connector has a solder tail extending beyond the insulative base;

the cable includes a power wire connected to a first surface of the solder tail; and the physical resistor is soldered to an opposite second surface of the solder tail.

9. The cable connector assembly as claimed in claim 7, wherein;

the plurality of contacts of the first cable end connector are arranged in two rows;

the plural power contacts are disposed in the two rows, and all power contacts in the two rows are electrically connected; and the plural ground contacts are disposed in the two rows, and all ground contacts in the two rows are electrically connected.

* * * * *